United States Patent [19]

den Hartog et al.

[11] 4,202,194

[45] May 13, 1980

[54] INCLINED ROLLING STAND

[75] Inventors: Huibert den Hartog; Klaus Stann, both of Dortmund; Lutz Stölze, Bonen, all of Fed. Rep. of Germany

[73] Assignee: Hoesch Werke Aktiengesellschaft, Dortmund, Fed. Rep. of Germany

[21] Appl. No.: 898,817

[22] Filed: Apr. 21, 1978

[30] Foreign Application Priority Data

Apr. 23, 1977 [DE] Fed. Rep. of Germany ..... 2718219

[51] Int. Cl.[2] ..... B21B 27/02

[52] U.S. Cl. ..... 72/78; 72/98

[58] Field of Search ..... 72/78, 98, 99, 100, 72/95, 96, 97

[56] References Cited

U.S. PATENT DOCUMENTS

| | | | |
|---|---|---|---|
| 374,703 | 12/1887 | Ritchie | 72/99 |
| 2,060,767 | 11/1936 | Assel | 72/100 |

FOREIGN PATENT DOCUMENTS

| | | | |
|---|---|---|---|
| 2009867 | 9/1971 | Fed. Rep. of Germany | 72/78 |

OTHER PUBLICATIONS

A.P.C. Application of Ichikawa, Ser. No. 371,079, Published May 4, 1943.

*Primary Examiner*—Lowell A. Larson

*Attorney, Agent, or Firm*—Becker & Becker, Inc.

[57] ABSTRACT

An inclined rolling stand for reducing a starting material to a pipe or rod, which includes a roll carrier adapted to be driven and to permit a central passage of the material to be rolled. The roll carrier includes three conical substantially identical and axially adjustable working rolls which are adapted to be driven and are inclined relative to the rolling axis at the same acute angle. The three working rolls are offset relative to each other around the rolling axis by 120° and are so directed with regard to the rolling axis that their extended axes respectively cross the rolling axis at the same short distances while the narrow ends of the conical working rolls respectively include a smoothing zone representing a surface of rotation about the axis of the respective working roll. The respective mantle line of the surface of rotation representing the smoothing zone is so concave that the respective concave mantle line contacting the material to be rolled, when rotating about the material to be rolled, forms the mantle surface of an imaginary cylindrical body.

3 Claims, 2 Drawing Figures

INCLINED ROLLING STAND

The present invention relates to an inclined rolling stand for reducing a starting material to a pipe or rod, in which the inclined rolling stand comprises a drivable roll carrier which permits a central passage of the material to be rolled and which includes three identical conical and axially adjustable working rolls which are adapted to be driven and which are inclined relative to the rolling axis at the same acute angle. The three working rolls are offset relative to each other around the rolling axis by about 120°, and these rolls are so directed with regard to the rolling axis that their extended axes respectively cross the rolling axis at the same short distances. The conical working rolls, at their thin ends, are respectively provided with a smoothing zone representing a surface of revolution about the working roll axis.

An inclined rolling stand of the above mentioned type for reducing solid cross sections has been disclosed in German Auslegeschrift No. 1 602 153. This known inclined rolling stand, however, has the drawback that even the smoothing zones provided on the conical working rolls, at an economical rolling speed of about 0.05–1.5 m/s, cannot produce a surface on the material to be rolled which can be considered as finished. The surface of the rolling material rather still does not conform to the desired shape, and these deviations from the desired shape are produced by the smoothing zones of the working rolls and have contours which deviate from the straight cylindrical mantle line of a triple thread to a considerable extent, so that a post-machining will be necessary to produce a finished product.

It is, therefore, an object of the present invention to provide an inclined rolling stand of the above mentioned general type by means of which it will be possible to produce a finished product, especially a pipe, at an economical rolling speed of at least 0.5 m/s, which will have a surface the errors as to shape of which will always by within the tolerance of 0 to $4\times10^{-3}$ times the diameter of the material to be rolled.

This object and other objects and advantages of the invention will appear more clearly from the following specification in connection with the accompanying drawing, in which.

The rolling stand according to the present invention is characterized primarily in that the respective mantle line of the surface of revolution which represents the smoothing zone is shaped concavely in such a way that the respective concave mantle line contacting the material to be rolled will, during the rotation about the material to be rolled, forms the mantle surface of an imaginary cylindrical body.

The maximum length of the projection of the respective concave mantle line of the smoothing zone on the rolling axis, which mantle line contacts the material being rolled, is mechanically limited.

The admissible advancing length of the material to be rolled respectively with regard to 120° of a revolution of the roll carrier, in order to be able to cover the entire surface of the material to be rolled, theoretically equals 1 times the above mentioned projection length.

For economical reasons, the advancing length should be selected as close as possible to the above mentioned limit.

Therefore, since a certain overlapping must be provided, the practical advancing length with regard to respectively 120° of a revolution of the roll carrier corresponds at a maximum to 0.9 times the theoretically possible advancing length. This means that the length of the projection of the respective concave mantle line of the smoothing zone on the rolling axis, which mantle line contacts the material to be rolled, corresponds to at least 1.1 times the advancing length which is produced by each working roll over 120° of one revolution of the roll carrier.

Finally, the parts of the smoothing zone of the working rolls are in an advantageous manner exchangeably arranged. This will assure a better possibility of machining of the smoothing zone parts independently of the reduction parts of the working rolls. Moreover, the same set of working rolls can be used for different diameters of the material to be rolled, because it is merely necessary to correspondingly exchange the smoothing zone parts.

Figure 1:
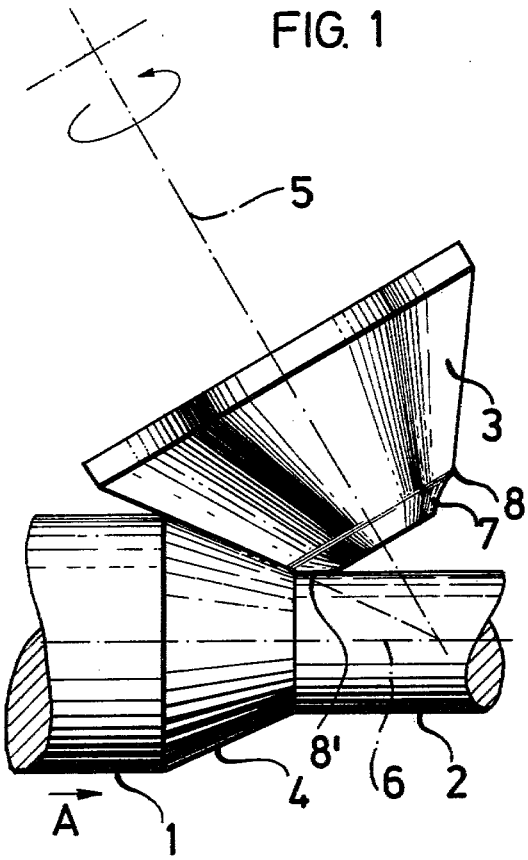
FIG. 1 is a side view of a working roll according to the present invention with the material to be rolled.
Figure 2:
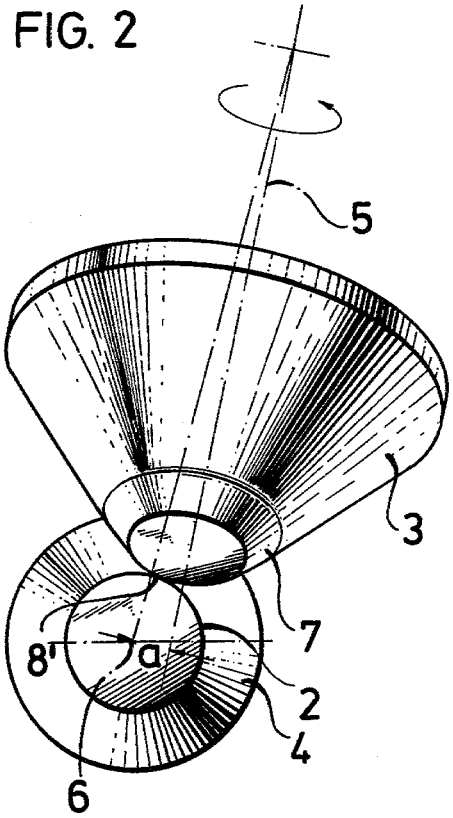
FIG. 2 is a front view of the working roll of FIG. 1.

Referring now to the drawing in detail, FIGS. 1 and 2 illustrate the mutual arrangement of the material to be rolled and of a conical working roll of a non-illustrated inclined rolling stand. The non-machined material 1 to be rolled is reduced to a cylindrical rod 2 by means of the reducing part 3 of the working roll in the reduction region 4 proper. The working roll is rotatable about its axis 5 which forms an acuteangle with the rolling axis 6. The working roll is rotatable and together with other non-illustrated working rolls is arranged in the non-illustrated roll carrier which is rotatable about the rolling axis 6. In order at all to be able to produce an advance of the material to be rolled in the rolling direction A, the working roll, as well as the other non-illustrated working rolls, are so directed with regard to the rolling axis 6 that the extended axes 5 respectively cross the rolling axis 6 at identical short distances a. The conical working rolls respectively have their thin ends provided with a smoothing zone 7 the mantle line 8 of which is concavely designed in such a way that the concave mantle line 8' which contacts the material to be rolled forms around the material to be rolled the mantle surface of an imaginary cylindrical body.

This concave smoothing zone 7 produces the smooth surface of the rod 2.

If seamless pipes are to be produced, a supporting mandrel is provided, in a manner known per se, between the working rolls. This mandrel is supported against the rolling direction.

As will be evident from the above, the advantages of the inclined rolling stand according to the invention are seen primarily in that the inclined rolling stand can be used as finishing stand at economical rolling speeds with high surface qualities of the material to be rolled and with a tolerance of always between 0 to $4\times10^{-3}$ times the diameter of the material to be rolled. As a result thereof, for instance, seamless pipes can be produced in one single inclined rolling stand with one mandrel while the rolled material excels by a high surface quality and rather minor faults as to shape with regard to diameter and wall thickness tolerances, while permitting a highly economical manufacture.

It is, of course, to be understood that the present invention is, by no means, limited to the specific showing in the drawing but also comprises any modifications within the scope of the appended claims.

We claim:

1. An inclined rolling stand for reducing a starting material to cylindrical form such as rods and pipes, which comprises in combination: a roll carrier adapted to be driven and to permit a central passage of the material to be rolled, said roll carrier also comprising three conical substantially identical and axially adjustable working rolls which are adapted to be driven and are inclined relative to the rolling axis at the same acute angle, said three working rolls being offset relative to each other around the rolling axis by 120°, each of said conical rolls being angularly displaced relative to an axial plane of said rolling axis through the conical roll so that the axis of said conical roll is at an angle to said axial plane, the smaller end of each conical roll being formed as a concave surface of revolution about the axis of said conical roll and curved in a plane through the axis of said roll to form a concave smoothing zone, said surface curvature conforming to the finished surface of the cylindrical form, so that said starting material is finished by said conical rolls.

2. A rolling stand in combination according to claim 1, which the length of the projection upon the rolling axis of the respective concave mantle line of the concave smoothing zone which contacts the material to be rolled corresponds to at least 1.1 times the advancing length generated by the respective working roll over a 120° rotation of the roll carrier.

3. A rolling stand in combination according to claim 2, in which those portions of said working rolls are exchangeable which form the respective smoothing zone.

* * * * *

UNITED STATES PATENT AND TRADEMARK OFFICE

CERTIFICATE OF CORRECTION

PATENT NO. : 4202194

DATED : 13 May 1980

INVENTOR(S) : Huibert den Hartog et al

It is certified that error appears in the above-identified patent and that said Letters Patent are hereby corrected as shown below:

[75] Inventors: Huibert den Hartog; Klaus Stamm, both of Dortmund; Lutz Stölze, Bönen, all of Fed. Rep. of Germany Signed and Sealed this

*Fifth* Day of *August 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4202194

DATED : 13 May 1980

INVENTOR(S) : Huibert den Hartog et al

It is certified that error appears in the above—identified patent and that said Letters Patent is hereby corrected as shown below:

[75] Inventors: Huibert den Hartog; Klaus Stamm, both of Dortmund; Lutz Stolze, Bünen; all of Fed. Rep. of Germany THIS CERTIFICATE SUPERSEDES CERTIFICATE OF CORRECTION ISSUED August 5, 1980.

Signed and Sealed this

*Thirteenth* Day of *January 1981*

[SEAL]

*Attest:*

SIDNEY A. DIAMOND

*Attesting Officer*

*Commissioner of Patents and Trademarks*